United States Patent [19]

Alfer

[11] Patent Number: 4,673,216

[45] Date of Patent: Jun. 16, 1987

[54] BASIC LOTUS POSTURE COMFORT SEAT

[76] Inventor: Jaroslaw G. Alfer, 350 S. Figueroa St., Ste. 117 - 752, Los Angeles, Calif. 90071

[21] Appl. No.: 739,530

[22] Filed: May 31, 1985

Related U.S. Application Data

[63] Continuation-in-part of Ser. No. 638,053, Aug. 6, 1984, abandoned.

[51] Int. Cl.[4] ..... A47C 7/02

[52] U.S. Cl. ..... 297/452; 297/423; 297/DIG. 1; 5/431; 5/443

[58] Field of Search ..... 297/423, 452, 458, 459, 297/457, DIG. 1; 5/431, 436, 443, 434

[56] References Cited

U.S. PATENT DOCUMENTS

| | | | |
|---|---|---|---|
| 94,702 | 2/1870 | Marks | 5/434 X |
| 679,915 | 8/1901 | Rudolf | 297/452 X |
| 2,800,165 | 7/1959 | Talalay et al. | 297/DIG. 1 |
| 2,819,712 | 1/1958 | Morrison | 297/DIG. 1 |
| 2,981,317 | 4/1961 | Cartwright, Jr. et al. | 297/452 |
| 3,205,010 | 9/1965 | Schick | 297/458 X |
| 3,337,884 | 8/1967 | Meier | 297/452 X |
| 3,528,116 | 9/1970 | Fenar | 297/DIG. 1 |
| 3,890,004 | 6/1975 | Rail | 297/423 |
| 3,968,530 | 7/1976 | Dyson | 5/436 |
| 4,179,158 | 12/1979 | Flaum et al. | 297/DIG. 1 |
| 4,244,764 | 1/1981 | Ginsburg | 297/DIG. 1 |
| 4,354,677 | 10/1982 | Young | 297/459 X |

FOREIGN PATENT DOCUMENTS

| | | | |
|---|---|---|---|
| 1011745 | 7/1957 | Fed. Rep. of Germany | 297/458 |
| 2052965 | 2/1981 | United Kingdom | 297/459 |

*Primary Examiner*—Kenneth J. Dorner
*Assistant Examiner*—Laurie K. Cranmer
*Attorney, Agent, or Firm*—William H. Maxwell

[57] ABSTRACT

A seat for persons using the cross-legged "lotus" sitting position, characterized by a substantially horseshoe-shaped support with top and bottom surfaces and with a broad central portion for supporting the buttocks, and comprised of a pair of bilaterally symetrical and divergent sections with piers extending forwardly establishing a space therebetween to lower and to position both feet and folded lower legs with the buttocks raised for comfort; a unit to be used at floor level or raised by and/or incorporated in a chair or the like.

2 Claims, 10 Drawing Figures

20
26
12
14
16
18
22
24
46
4
5

20
26
12
14
16
18
22
24
46
4
5

BASIC LOTUS POSTURE COMFORT SEAT

This is a continuation-in-part of my copending application Ser. No. 638,053 filed Aug. 6, 1984, now abandoned, entitled Basic Lotus Posture Comfort Seat.

FIELD OF THE INVENTION

This invention relates to seats for sitting in the cross-legged "lotus" position.

BACKGROUND OF THE INVENTION

The cross-legged or so-called "lotus" sitting position is a convenient and popular way of sitting when conventional furniture is not readily available. In addition, it is particulary popular in many Asian countries, both for work and for leisure, and in connection with Yoga exercises. For example, medical research at the Department of Physiology, Medical College, Aurangbad, in India, has suggested the use of cross-legged sitting position for "conditions of low cardio respiratory reserves" and concluded that, ". . . the Padmasana [lotus posture] has a definite place as a form of exercise in common man for efficient performance of his daily activities." (Effects of Padmasana, A Yogic Exercise on Muscular Efficiency, by D. S. Salgar et al, Pub. Indian J Med Res 63, 6, June 1975.) Incidently, much medical research, in numerous countries, suggest significant positive results gained in the area of treating psycho-somatic stress through the use of meditation techniques in which traditionally the lotus position is used. However, the cross-legged, or lotus seating position is not very comfortable when it is maintained for a long period of time. More specifically, the thighs and knees tend to be stressed, pressure occurs on the ankles and feet, and the buttocks may become uncomfortable through resting on a relatively hard floor or other such surface. Accordingly, it is a general object of this invention to provide comfortable enforcement of the lotus posture in a simple, inexpensive, and basic seat at or above the floor.

One seat construction which has been proposed for similar purposes, is shown in U.S. Pat. No. 3,890,004 granted July 17, 1975 to Larry E. Rail. However, the construction shown in this patent is in the nature of a reclining body support and is so elaborate and complex as to not fulfull the need for a basic simple seat for increasing the comfort of persons in the cross-legged seated position. Other pillows and pads have been proposed heretofore for other purposes; however, they are not intended, designed or constructed to accomodate the needs of persons having their legs crossed in the characteristic manner of the lotus posture. Accordingly, it is another object of this invention to accomodate the crossed lower legs or calves and to simultaneously position them and the person's feet in a comfortable condition with the buttocks slightly raised. With the present invention there is a leg and foot space established between upper leg or thigh supporting piers that diverge from a central buttock support portion. A proper and comfortable lotus posture is thereby inherently enforced.

SUMMARY OF THE INVENTION

In accordance with this invention, a seat for persons using a cross-legged or lotus seated position includes a substantially horseshoe-shaped body support having a substantially flat bottom and a flat top surface, and a broadened central portion for supporting the buttocks.

In addition, the seat has a pair of piers extending forwardly and outwardly from the central portion at an angle relative to one another between 30 and 60 degree, and with the piers of the seat being sufficiently long to support a person's upper legs or thighs to about the knees, and having a length of about two feet from the rear of the central portion to the end of the piers.

Features of this Basic Lotus Posture Comfort Seat include the following:

(1) The piers are slightly inturned at their outer extremities so as to be parallel.

(2) The central seat portion has a substantial forward extension between the two piers for stability.

(3) The space between the two piers is open and the distance from the central portion to the ends of the piers is of an order to accommodate the length to one's normal foot which is positioned by the inner surface of the pier. The said space or open area between the inturned ends of the piers is of an order to accommodate the folded lower legs and feet.

(4) The seat is preferably formed of foam material.

(5) The foam resilience of the piers of the seat is preferably greater so that they are more compressible than the main central portion on which the buttocks are supported.

(6) A thin layer of high resiliency foam is preferably coextensive over the top of the seat.

(7) The seat is preferably hinged at the upper surface, extending centrally through the main seating portion so that the seat can be folded over and used double for squatting on for meditation or for storage and portability purposes.

(8) The seat can be constructed for filling it with particulate material or for inflation by fluid, either gas or liquid, in which case it would have suitable internal structural partitions to maintain the approximate desired configuration.

(9) The seat can be constructed out of rigid materials, so as to be mounted on a chair or like frame.

(10) A simple back-rest is provided, either pivoted to the central seat area or resting against the wall, or arranged with a base rigid shell for self sufficient support.

(11) The seat is preferably in the order of two or three inches to six or eight inches in thickness, with a thickness of about four inches being preferred.

(12) The seat is advantageously made to fit conventional seating furniture such as stools, chairs, armchairs and sofas.

Among the advantages of this Basic Lotus Posture Comfort Seat for persons in the cross-legged lotus position, are that it relieves stress from the thighs and knees, removes pressure from the ankles and feet, and the buttocks are comfortably raised on a resilient or firm foundation, which helps to keep a straighter spine. Thus, one is able to sit for longer periods of time than would otherwise be practical.

The foregoing and various other objects and features of this invention will be apparent and fully understood from the following detailed description of the typical preferred forms and application thereof, throughout which description reference is made to the accompanying drawings.

THE DRAWINGS

Figure 10:
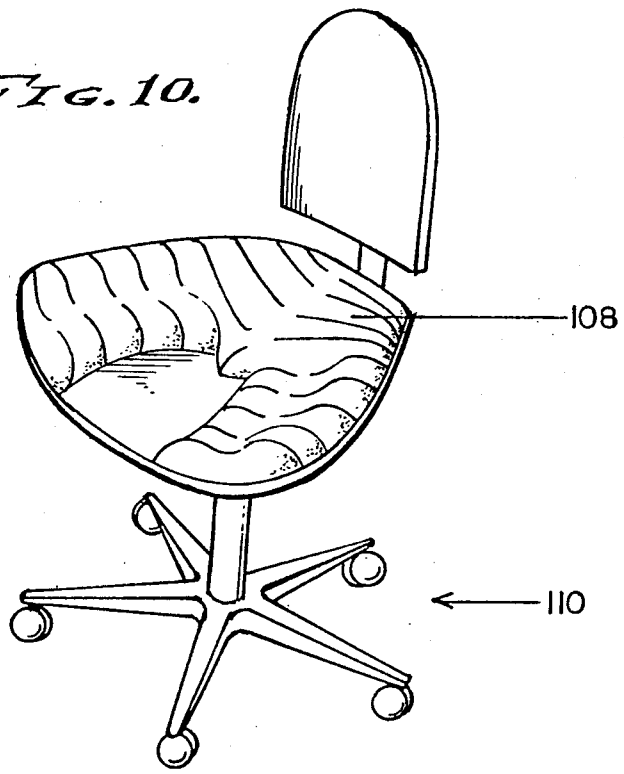

And, FIG. 10 shows the seat of this invention fabricated out of substantially rigid material made to conform to the anatomy of the body and incorporated in a swivel chair assembly.

PREFERRED EMBODIMENT

Figures 1, 2:
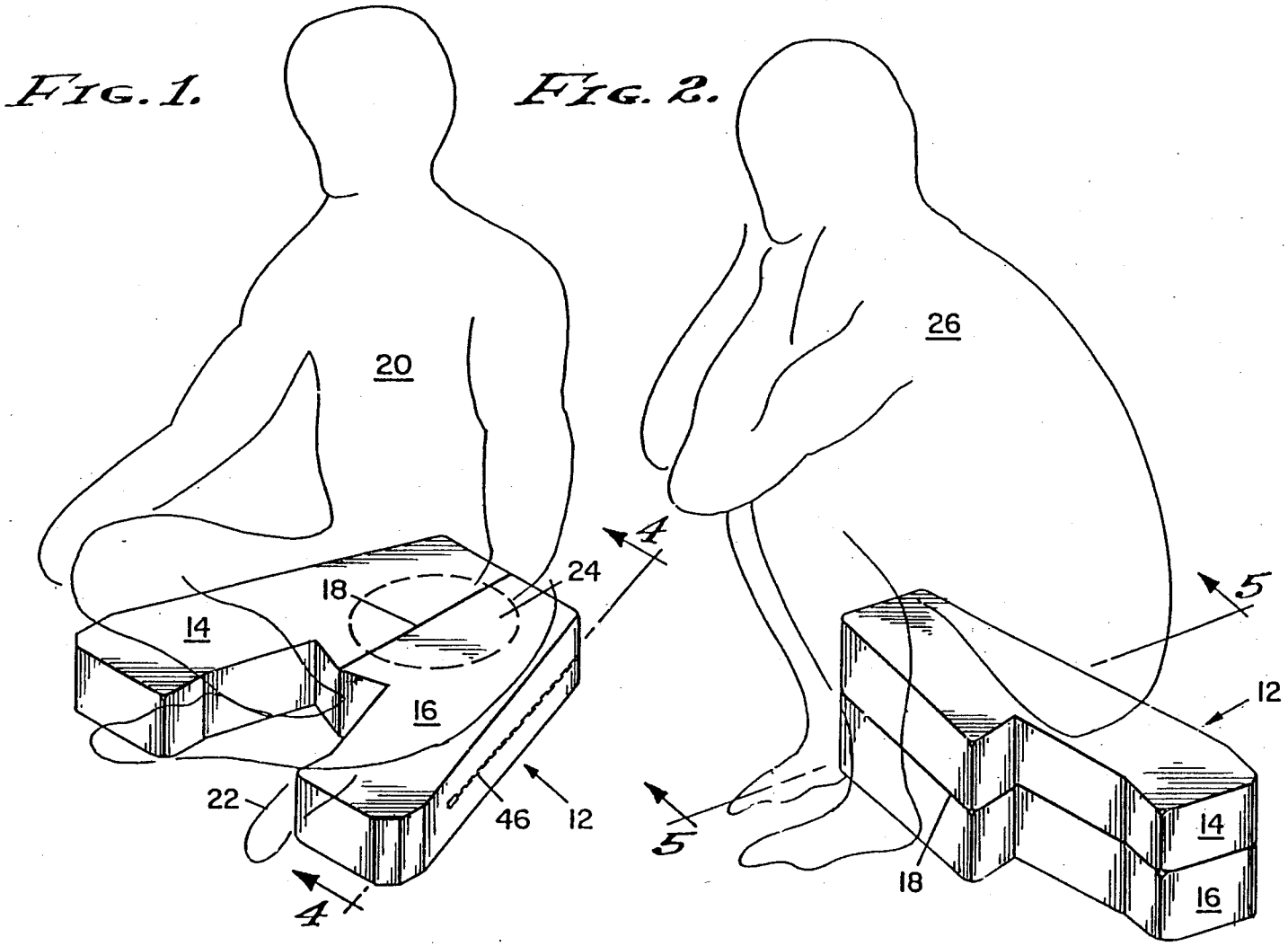
FIG. 1 is a diagramatic view of a seat illustrating the principles of the invention as used by a person in the cross-legged lotus posture.
FIG. 2 shows the seat of FIG. 1 folded and used by person in a squatted meditation posture.
Figures 1, 2:
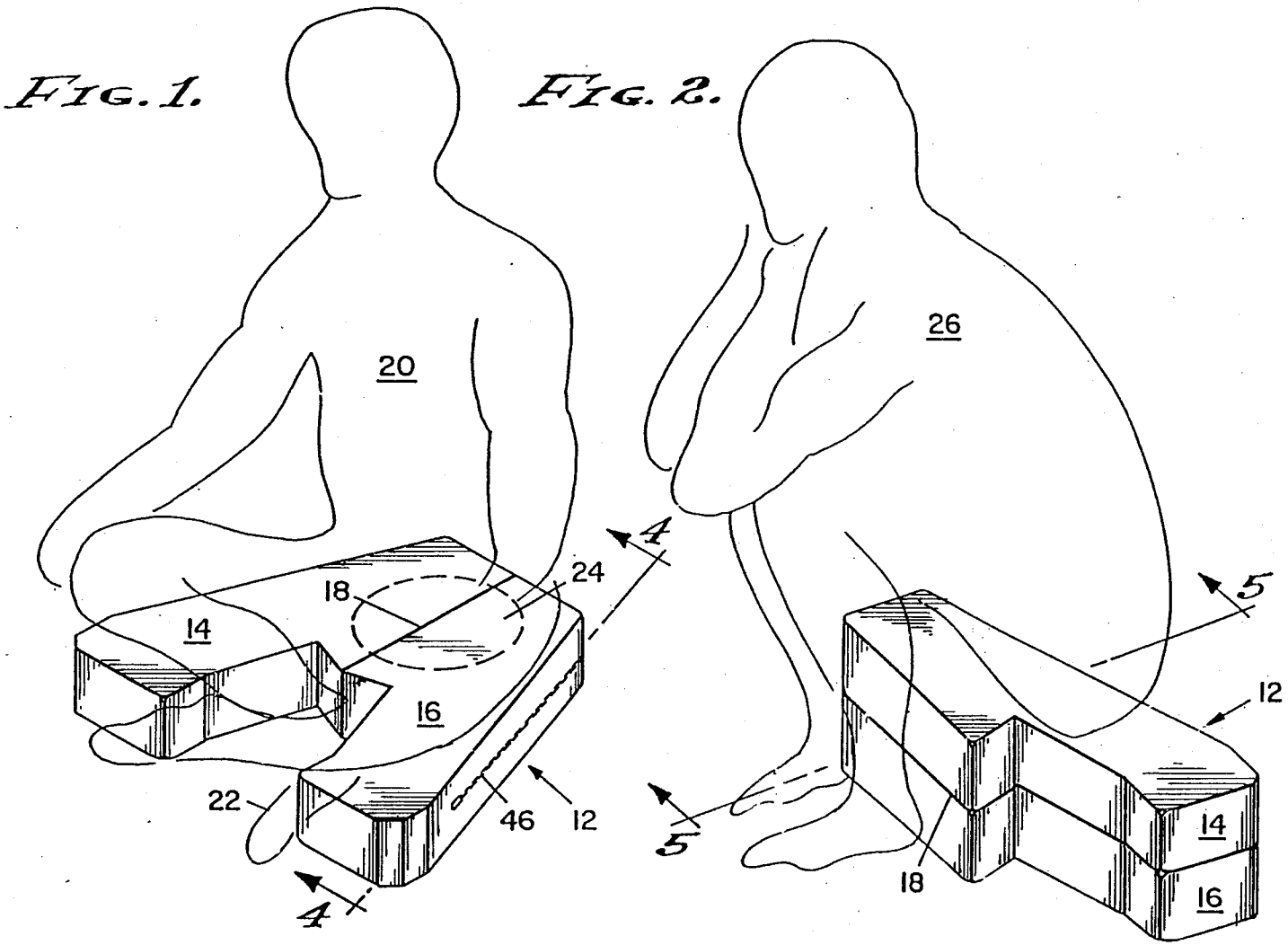

Referring now to the drawings, FIG. 1 shows the basic seat 12, illustrating the principles of the invention, and formed of two bilaterally symetrical sections 14 and 16 which are provided with fabric covers (48 and 58) and which are hinged along a line 18 by the fabric cover material so that the two sections may be folded as shown in FIG. 2. In FIG. 1 the user 20 is shown with his legs crossed in a lotus position, with his feet 22 and 23 in engagement with the inner surfaces of the sections 14 and 16, and his buttocks resting on the main central portion indicated at 24 in FIG. 1. The seat 12 is shown to be comprised of the complementary sections 14 and 16 that form the central portion 24, and having top and bottom surfaces 17 and 19 (see FIG. 4) which are normally flat.

FIG. 2 shows a person 26 squatting in meditation with his hands covering his eyes and ears, and his elbows resting on his knees. For this meditation posture the cross-legged posture is not appropriate, and accordingly the seat is folded about the line 18 of fabric material, by which the two sections 14 and 16 of the seat are joined, i.e., the seat is foldable.

Figure 3:
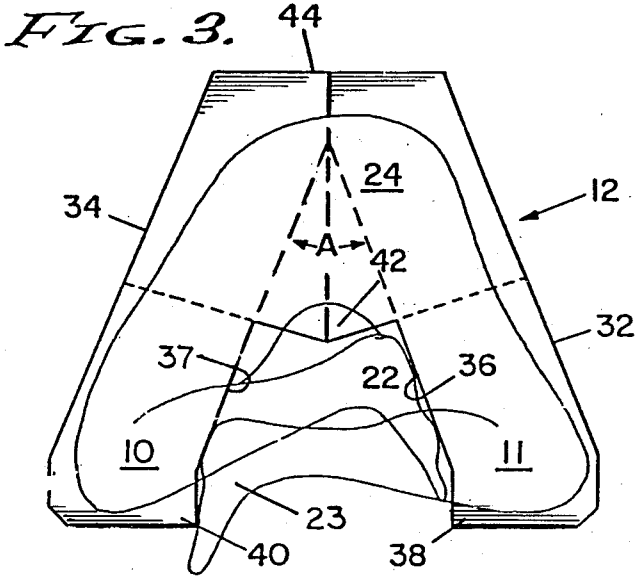
FIG. 3 is a plan view of a seat illustrating the principles of the invention and showing how the feet and buttocks of the user are oriented relative to the seat.

FIG. 3 is a plan view of the basic seat configuration showing the person's buttocks supported on the main portion 24, with the upper legs or thighs of the user extending out along the outwardly divergent piers 10 and 11 extending from the central portion 24 of the seat. In addition, as mentioned above, one foot 22 of the user extends along and against the inner surface 36 of one pier 10, and the other foot 23 extends along and against the inner surface 37 of the other pier 11, of the seat 12. Furthermore, some persons may use the outer pier ends as buffers to cushion for comfort between the folded lower legs, instead of using the piers only as supports for the thighs and knees.

Note that the inner surfaces 36 and 37 of the piers 10 and 11 make an included angle "A" (FIG. 3) of divergence which is between 30 and 60 degrees, and which is preferably about 45 degrees. In addition, the inturned corners 38 and 40 of the piers 10 and 11 serve to support the bent knee portions of the legs, when they are crossed. A central and forwardly extending nose 42 projects from the central portion 24 and between the surfaces 36 and 37 to prevent a forward tilting of the seat which was found to take place when this portion of the seath was not included. This nose 42 extends only a few inches forwardly, and otherwise leaving the space between the piers 10 and 11 entirely free, clear and totally unobstructed. Note that the distance from the rear face 44 of the central portion 24 to the outer ends of the two piers 10 and 11 is approximately two feet, although somewhat longer or shorter distances may be employed for use by larger or smaller persons. Similarly, the width of said central portion 24 may vary with different size requirements.

The divergent inclusive angle of the piers at approximately 45 degrees is conducive to comfort, in that the cross-legged positioning puts the plantar surfaces of the feet 22 and 23 more or less flat upon the pier surfaces 36 and 37; with the toes turned up slightly by the inturned corners 38 and 40. Further, the rearward withdrawal of either foot 22 or 23 is properly restricted and positioned by either face of nose 42 engageable with the heel of the foot, establishing the foot at a right angle or normal to the lower leg (see FIG. 3). Thus, the lotus posture is inherently enforced without overly stressing the thighs, the knees, or the ankles, and as a result the person remains comfortable in the lotus posture over extended lengths of time.

Figure 4:
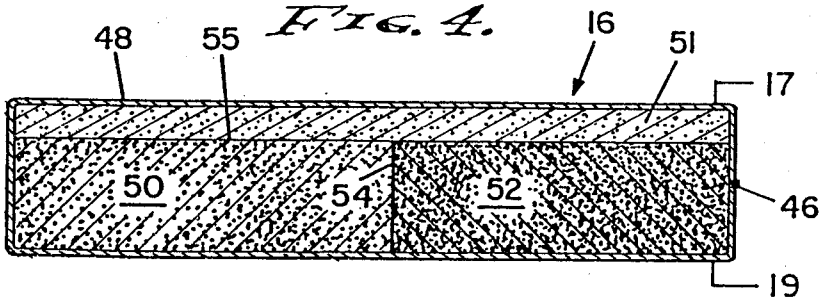
FIG. 4 is a cross-sectional view taken as indicated by lines 4—4 in FIG. 1.

FIG. 4 is a cross-sectional view showing the padding of graduated density. As shown, the section 16 and section 14 of the seat includes an outer fabric covering 48 and the three sections of foam pads 50, 51 and 52 which are joined to one another along the interfaces 54 and 55. The portion 52 of the unit is relatively firm form material, as this portion 52 forms a part of the broadened central area on which the user's buttocks will be supported, while the portion 50 being of more resilient material is intended to comfortably support the upper legs or thighs. The top layer 51 is less firm and more resilient that either of the two base portions 50 and 52, to more readily conform to the portions of the person's body which bear upon the layer 51. By way of example only but not of limitation, the Indentation Load Deflection, or the I.L.D, of 25% at four inches of section 52 may be about 60 to 90 lbs.; that of pad 50 about 30 to 50 lbs.; and that of foam pad 51 about 30 to 40 lbs.. However, the I.L.D. values may vary significantly with various types of materials in respect to their "support ratio" or "sag factor" known in the industry and broadly referred to as the "comfort factor" of which the ratio is computed from 25% to 65% I.L.D. readings; the object being the achievement of an ideal surface softness combined with a deep down firmness.

Figure 5:
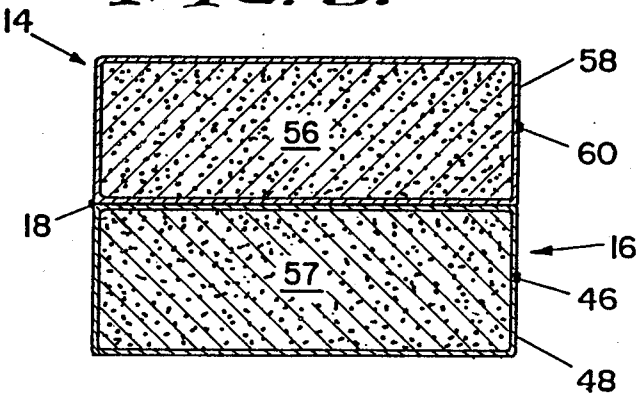
FIG. 5 is a cross-sectional view taken as indicated by lines 5—5 in FIG. 2.

FIG. 5 shows a modified foam pad construction in which the supplemental layer 51 as shown in FIG. 4 is not included. Accordingly, the upper section 14 of the seat as shown in FIG. 5 includes the central foam pad 56, and an outer fabric covering 58 and a zipper 60; and the lower section 16 includes a single foam pad 57. As mentioned above, the hinge line 18 is accomplished through the use of fabric which is secured and forms part of the covering for both of the two sections 14 and 16 of the seat.

As shown, the foam pads are secured and held in place within the fabric coverings by two zippers, such as zipper 46, which extend as shown in FIG. 1 from the side of the portion 16 of the seat and around to the rear thereof adjacent to the hinge line 18. A similar zipper (not shown) extends from the side and around to the rear of portion 14.

Figure 6:
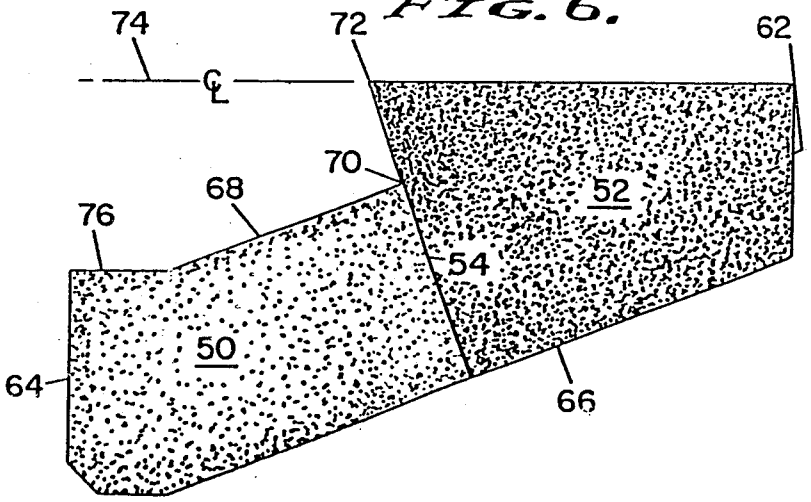
FIG. 6 is a plan view of one of the foam pads included in the assembly of FIGS. 1 or 2.

FIG. 6 shows the foam pad within section 16 of the seat 12 of FIG. 1, but with the covering 48 as shown in FIG. 4 removed, and the upper layer stripped away. Accordingly, the lower resiliency of firmer foam pad 52 is shown joined to the higher resiliency foam pad 50 along an interface 54. This joining and that of pad 51 along interface 55 may be done by the use of suitable solvents or by heat techniques as are known in the industry, or alternately left unlaminated.

For completeness, certain dimensions of the seat shown in FIGS. 1 through 6 will now be given. However, it is to be understood that these are merely for purpose of illustration of certain standardized medium dimensions, and they are not to be considered limiting, with larger or smaller persons being accomodated by larger or smaller seats, In all events, as representative dimensions that overall distance from rear face 44 to front face 64, perpendicular to these faces, is approximately 24 inches. This conforms to the overall length of the seat which was mentioned in the order of two feet from face 44 to the end of each pier 10 and 11. The width of each pier from surface 66 to surface 68 is approximately 7½ inches. The distance from the face 44 to the corner 70 of nose 42 is approximately one foot, and the distance to point 72 from face 44 is approximately 13 inches. The distance from centerline 74 to the inturned surface 76 of each pier is approximately 6 inches. The length of the surface 62 is approximately 6½ inches, thus making a transverse extent at the rear of the seat of about 13 inches plus the thickness of four layers of fabric covering.

Figure 7:
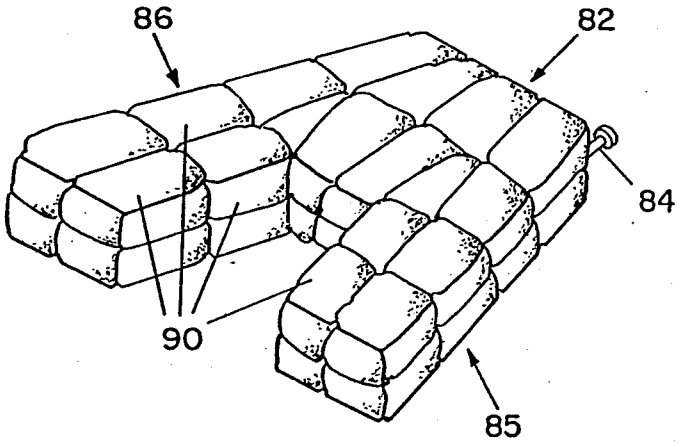
FIG. 7 shows an inflatable version of the invention.

FIG. 7 shows an embodiment of the seat 82 which is air inflatable, as indicated by the inlet valve 84. The seat of FIG. 7 is provided with much the same overall configuration as that of FIG. 1. However, the seat 82 is formed out of a number of interconnected cells 90 which are employed in order to maintain the desired surface configuration, and is accomplished in accordance with known practice, by providing a number of walls within the overall configuration of the inflatable seat, so that the seat will retain its desired configuration. Of course the internal walls are apertured so that a single inflation point 84 is adequate for inflation. It may be noted that on an overall basis the seat of FIG. 7 has substantially planar upper and lower surfaces, although this is modified necessarily by the inflatability feature.

Figure 8:
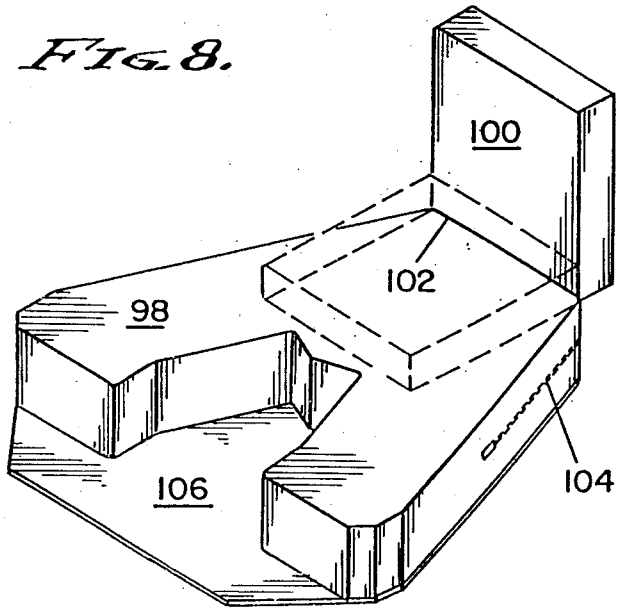
FIG. 8 shows the seat of this invention provided with a hinged backrest and a cushion pad on which the embodiment rests.

FIG. 8 shows the basic seat 98 provided with a hinged and foam type backrest 100 which is secured to the remainder of the seat by a fabric material which is joined along line 102 to the fabric covering the main portion of the seat. The arrangement shown in FIG. 8 is particularly suitable when the backrest 100 is to be leaned against a wall, or other solid supporting member, so that supplemental support is not needed. Incidently, for cases where the seat 98 is not foldable as shown in FIG. 8, the zipper 104 extends from the area as shown in FIG. 8 and around the back of the unit to a comparable position on the other side of the assembly. An optional pad or rug 106 may be provided to cushion the feet and ankles, and ot provide increased comfort to the assembly.

Figure 9:
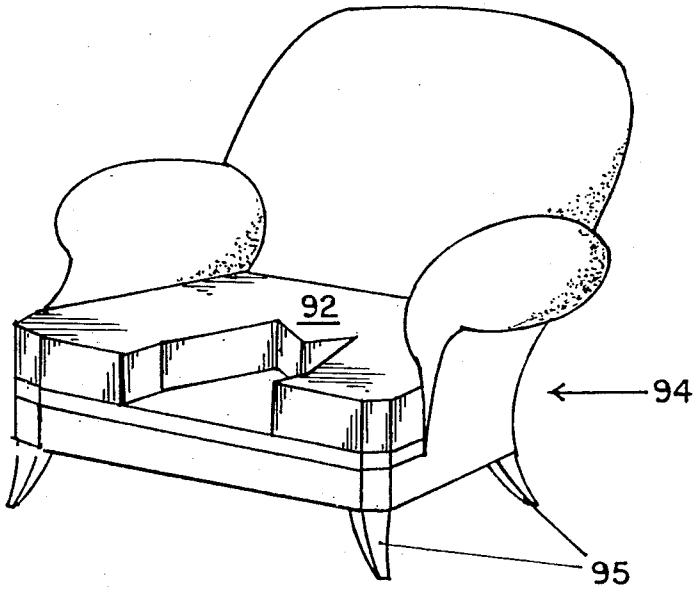
FIG. 9 shows the seat of this invention made to fit a conventional type armchair.

FIG. 9 shows the basic seat 92 made to fit a conventional type armchair assembly 94, with legs 95.

FIG. 10 shows the embodiment of the basic seat 108 fabricated out of rigid material with a surface configuration somewhat following the human anatomy, on an office-type chair assembly 110. Said surface configuration is still relatively flat on the upper surface of the seat.

From the foregoing it will be apparent that the configuration of the seat of the present invention is designed to eliminate muscle tension which might occur during prolonged motionless sitting in the cross-legged lotus position. The relationship between the shape of the seat and the anatomy of the cross-legged position may be said to be synergetic, thus it relieves stress from the thighs and knees, removes pressure from the ankles and feet, and additionally the buttocks are comfortably seated on a raised and soft but firm foundation, and the spine is maintained erect with greater ease which in turn removes stress from the lower back area.

In conclusion, it is to be understood that the foregoing detailed description and the accompanying drawings merely illustrates preferred forms of the invention. Thus by way of example, but not of limitation, the seat may be implemented using an outer flexible housing or covering of the desired configuration, and filling the interior with fluid substances such as air, water, oil, soft wax or clay, or with particulate or fibrous materials. In addition, instead of having the material made of foam as shown, somewhat less resilient or even rigid material can be employed, with a surface configuration somewhat following the human anatomy, but still relatively flat at the upper and lower surfaces of the seat, or a similar result can be achieved by extracting air from an airtight seat housing by means of a vacumm pump in which case the seat may be filled with styrene beads for example, a process known in the industry.

Having described only the typical preferred forms and applications of my invention, I do not wish to be limited or restricted to the specific details herein set forth, but wish to reserve to myself any modifications or variations that may appear to those skilled in the art as set forth within the limits of the follwoing claims.

I claim:

1. A seat for the support and positioning of legs and knees and feet of persons sitting in a cross-legged posture, and including;

a substantially horseshoe-shaped support of flexible material and of bilaterally symetrical configuration with horizontally parallel top and bottom surfaces and comprised of opposite side sections and each with a buttock support portion and a forwardly projecting pier support for an upper leg, the piers of the opposite side sections being separated one from the other by a transverse front of the buttock portions to accomodate a heel of the person's feet and forwardly and laterally divergent and separated by an unobstructed space therebetween and each having an inner face to engage and position a plantar surface of the person's foot, and alternately under which a portion of the person's foot can be lodged, a central nose projecting forwardly from the transverse front of the buttock support portions of the side sections and stopping short of the person's crossed lower legs and extending between the divergent piers for stabilizing of the buttock support portions, and the buttock support portions of the side section and upper leg supporting piers extending therefrom having coplanar top surfaces for the support of the buttocks and upper legs in a raised horizontal condition and with the lower legs extending cross-legged and freely into and across the unobstructed space between the piers.

2. The lotus posture seat as set forth in claim 1, wherein a central nose has opposite side faces to stop and position the heels of the person's feet.

* * * * *